United States Patent [19]

Jimenez

[11] Patent Number: 5,042,407

[45] Date of Patent: Aug. 27, 1991

[54] DEVICE HAVING ADJACENT PLATES WITH THREAD GRIPPING SURFACES FOR CONTROLLING THREAD TENSION THEREBETWEEN

[75] Inventor: Antonio Jimenez, Meyrin, Switzerland

[73] Assignee: Mefina SA, Switzerland

[21] Appl. No.: 408,032

[22] Filed: Sep. 15, 1989

[30] Foreign Application Priority Data

Sep. 16, 1988 [CH] Switzerland ..... 3454/88

[51] Int. Cl.[5] ..... D05B 47/00; D05B 47/02; D05B 47/04

[52] U.S. Cl. ..... 112/254; 112/150; 112/255

[58] Field of Search ..... 112/97, 225, 254, 255, 112/273, 278, 302

[56] References Cited

U.S. PATENT DOCUMENTS

| | | | |
|---|---|---|---|
| 2,080,893 | 5/1937 | Klein | 242/150 |
| 2,720,366 | 10/1955 | Brown | 242/150 |
| 2,758,802 | 8/1956 | Carlson | 242/150 |
| 3,000,591 | 9/1961 | Backlin | 112/254 X |
| 3,347,195 | 10/1967 | Gegauf | 112/254 |
| 3,366,083 | 1/1968 | Ketterer | 112/254 |
| 3,472,190 | 10/1969 | Gegauf | 112/254 |
| 4,092,939 | 6/1978 | Knowles | 112/254 |
| 4,111,140 | 9/1978 | Gonnai | 112/254 |
| 4,123,984 | 11/1978 | Coucombe | 112/254 |
| 4,159,005 | 6/1979 | Jimenez et al. | 112/254 |
| 4,246,857 | 1/1981 | Gonnai | 112/254 |
| 4,356,781 | 11/1982 | Rodda | 112/255 X |

FOREIGN PATENT DOCUMENTS

| | | | |
|---|---|---|---|
| 2000268 | 7/1971 | Fed. Rep. of Germany | 242/150 |
| 0808067 | 1/1959 | United Kingdom | 242/150 |

*Primary Examiner*—Werner H. Schroeder
*Assistant Examiner*—Ismael Izaguirre
*Attorney, Agent, or Firm*—Cushman, Darby & Cushman

[57] ABSTRACT

A device is provided for controlling the tension of a longitudinally moving thread. The device includes at least two adjacent plates which are applied one against the other and between which the thread passes. The plates, and thus the thread, can be tightened so that the desired tension can be creatred. Opposed surfaces of the plate each incorporate at least one gripping surface for the thread which cooperates with at least one corresponding gripping surface of the other plate. The periphery essentially about the surfaces is formed with at least two indentations arranged in such a way that each indentation of the gripping surface of a plate coincides with at least a portion of a corresponding indentation on the gripping surface of the other plate. At least in one relative angular position of the plates, the pairs of indentations so superimposed define, on the periphery of the gripping surfaces of the plates, two distinct and concave lips, the structure further ensuring the maintenance of the plates in the angular position and imposing on that portion of thread crossing the device at any instant a trajectory such that the thread enters between the gripping surfaces of the plates by one of the lips and leaves by the other lip.

9 Claims, 3 Drawing Sheets

DEVICE HAVING ADJACENT PLATES WITH THREAD GRIPPING SURFACES FOR CONTROLLING THREAD TENSION THEREBETWEEN

BACKGROUND OF THE INVENTION

Sewing machines are known incorporating, upstream of the sewing needle, a device for controlling the tension of the sewing thread comprising at least two substantially flat plates, applied one against the other and between which the thread passes, a manually controlled device allowing tightening of the plates, and thus the thread, with a force of intensity characteristic of the tension desired at least on the portion of the thread extending downstream of the plates.

Such devices are not always entirely satisfactory, the thread naturally having a tendency to come out little by little from between the plates, until it is free from the device in question which then becomes inoperative. This displacement of the thread is due to the fact that, even though the thickness of such a thread is generally very small, of the order of several tenths of a mm to 1 mm for example, under the action of the tightening force to which they are subjected, the plates come into contact on the one hand on each other, at a point distant to the thread, and, on the other hand individually, on the thread itself. It follows that there is created on the thread a sort of "wedge" effect which is manifested by a force tending to push the thread in the opposite direction to the zone of mutual contact of the plates. When this force is superior to the frictional action of the plates on the thread, due to the tightening of these, the thread is displaced from between the plates until it is ejected.

Among the arrangements proposed to try to overcome this classic type of disadvantage, we refer to that disclosed in U.S. Pat. No. 4,123,984 (Singer) which proposes forming the periphery of each of the plates with two diametrically opposed indentations, arranged in such a way that the indentations of one plate are arranged in superimposed alignment with the corresponding indentations of the other plate, in an angular position relative to the plates, the pairs of superimposed indentations forming on the periphery of the assembly of the two plates, two distinct and concave lips (edges). In this device the thread is guided in such a way that it enters the plates across one of the lips, preferably near to one extremity of the lip in question, and that it leaves the device at a distance by the second lip.

This arrangement does not really give satisfaction, on one hand, because of certain types and dimensions of thread, and on the other hand, and even more so, in the case of sewing of simple designs, that is to say not requiring, for their formation, a significant density of thread per unit of surface, and moreover where the cloth for sewing is not too thick. In effect if, in the course of its passage in the zone of the plates close to the first edge thereof, the trajectory of the thread is very controlled for the reasons mentioned in the U.S. Pat. No. 4,123,984, this thread is more and more abandoned to itself in the course of its subsequent penetration between the plates so that the "wedge" effect hereinbefore mentioned rapidly becomes dominant and the thread acquires, here also, a natural tendency to leave the device.

SUMMARY OF THE INVENTION

The present invention has for its object a controlling device of the type hereinbefore referred to but not having the disadvantages mentioned, and whose essential characteristics are the subject of claim 1.

Like that described in U.S. Pat. No. 4,123,984 the device of the invention finds a particularly advantageous and effective use in sewing machines, whether they be of a purely mechanical, electro mechanical or electronic type, with or without a microprocessor.

BRIEF DESCRIPTION OF DRAWINGS

The accompanying drawings show, by way of example, an embodiment of the device of the present invention and of its practical mode of use in a sewing machine.

DETAILED DESCRIPTION OF THE DRAWINGS

Figure 1:
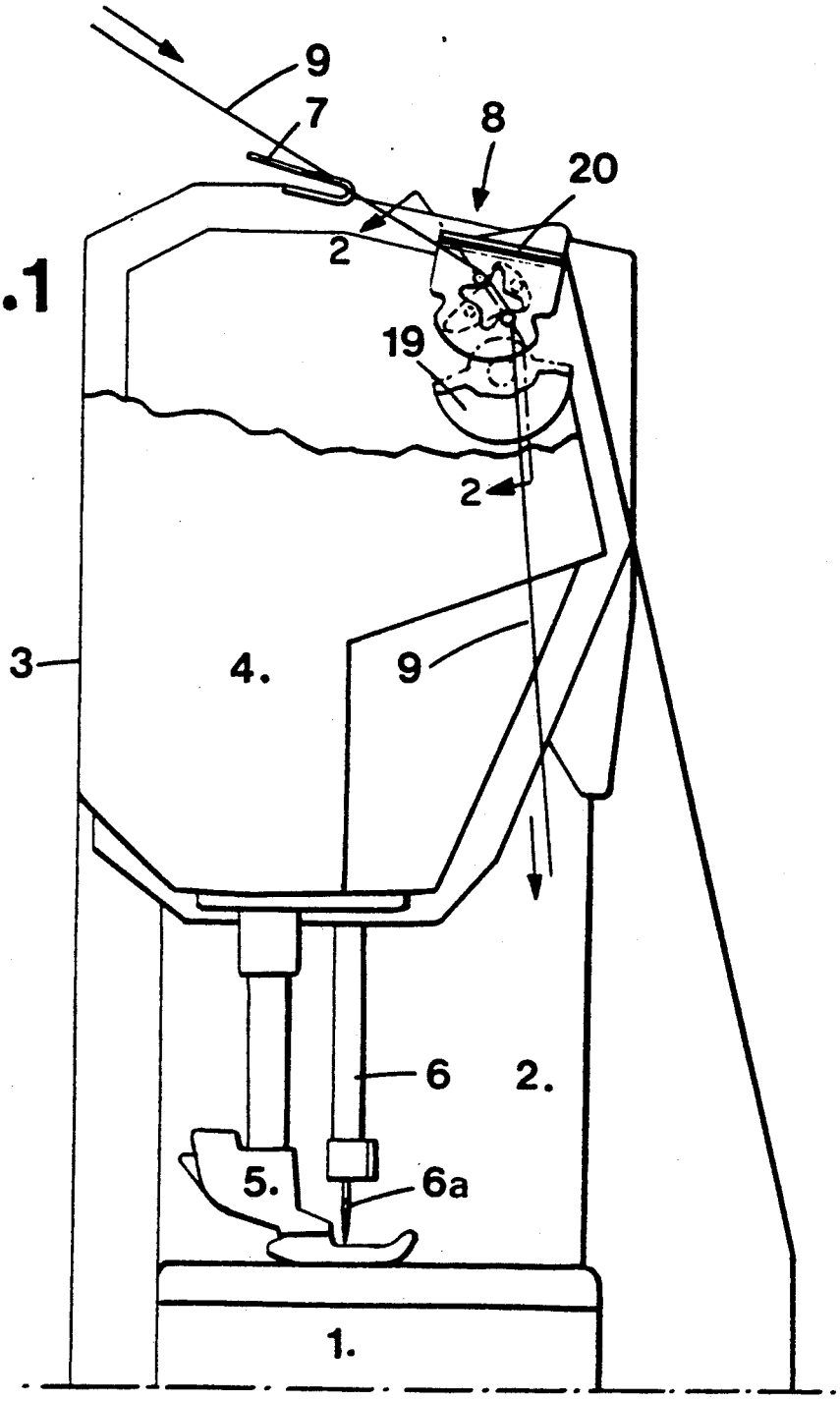
FIG. 1 is a side elevation, with part cut-away and partially in section, of a sewing machine, showing the location of the device according to the present invention.

The sewing machine shown in FIG. 1 comprises a lower arm 1, a column 2 supporting an upper arm 3, which extends out over arm 1 and terminates in a sewing head 4.

In conventional manner, arm 1 comprises a cloth feed mechanism and a loop pick-up control device neither of which are shown in the drawing.

The head 4 of the machine is provided with a presser foot 5, a needle bar 6, with a needle 6*a* fixed to the free end of the bar 6. The head 4 also carries a thread guide 7 and a device 8 which is intended to control the tension of the thread 9 which, during sewing, issues from a bobbin, not shown, passes through the thread guide 7 and then through the device 8 to connect up with the needle 6*a*.

Figure 2:
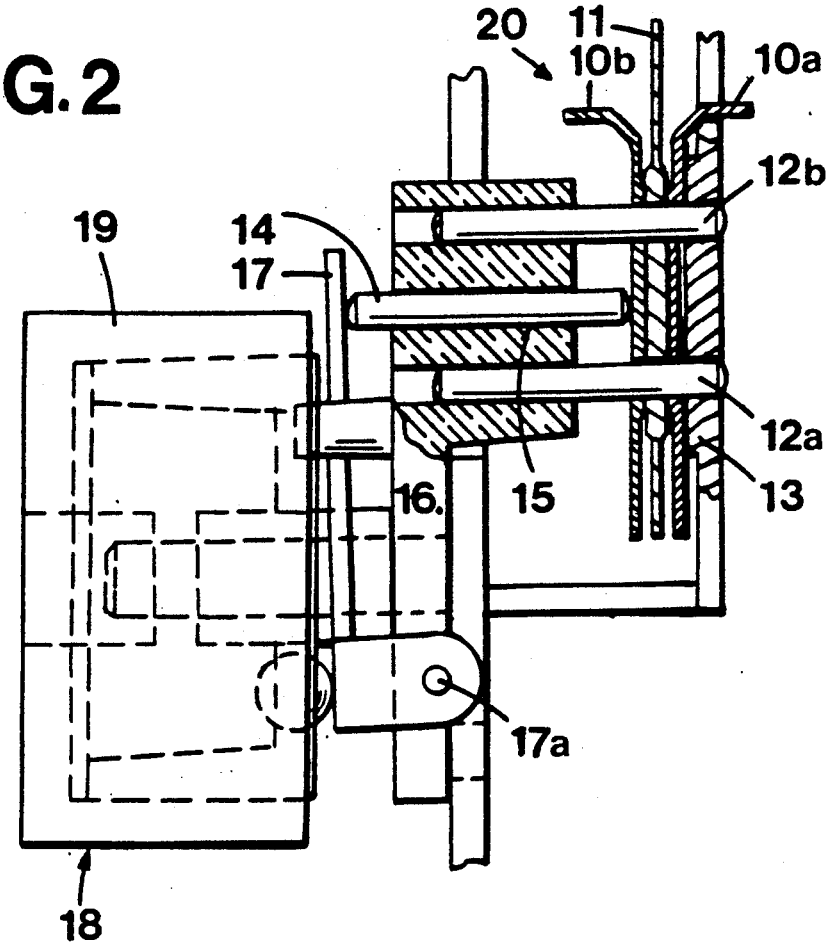
FIG. 2 is a section on the line II—II of FIG. 1 to a larger scale.

The device 8 comprises an assembly of three plates 10*a*, 11 and 10*b* (FIG. 2) which are slidably mounted on two parallel rods 12*a* and 12*b*, between an element 13, mounted on the head 4 of the machine, and a support rod 14 which is in contact, on its extreme right, with the left face of the plate 10*b*. The rod 14 is slidably mounted in a corresponding aperture 15 of a support 16 mounted on the head 4 and to which are fixed the above-mentioned rods 12*a* and 12*b*. The left extremity, on the drawing, of the rod 14 is subjected to the action of a lever 17, pivoted at 17*a*, which exerts, on the rod 14 a force the intensity of which can be varied by manual action exerted on a tightening device 18 of which 19 represents a control knob (FIGS. 1 and 2). The varying of the angular position of the knob 19 thus produces a more or less pronounced tightening on the plates 10*a*, 11 and 10*b*. The operating principle of this part of the device is well known to persons in the trade as it is to be found as such notably in the sewing machines Elna 5000, Elna 6000 and Elna 7000 marketed by the company TAVARO S.A. of Geneva (Switzerland).

It is due to this possibility of tightening of the plates that the device illustrated provides control of the tension of the thread destined for the needle of the machine.

It should be noted that the device of the invention can be used equally well when the machine is called upon to operate with a single needle as with a double needle. It will be appreciated that in the latter case it is necessary to provide for the control of the tension of two separate threads coming from two separate bobbins and each intended for one of the two needle rods which comprise a double needle. In this case one of the threads will be passed, for example between the plates 10*a* and 11 and, the other, between the plate 11 and the plate 10*b*.

The description which follows refers only to the case where the sewing machine is called upon to operate with a single needle, the thread being gripped between the plates 10*a* and 11. The assembly structure of the three plates 10*a*, 11 and 10*b*, being symmetric with respect to the middle plate 11, it is evident that that which will be described with reference to the pair of plates 10*a* and 11 will also apply, mutatis mutandis, to this same plate 11 and the plate 10*b*.

Figure 4A:
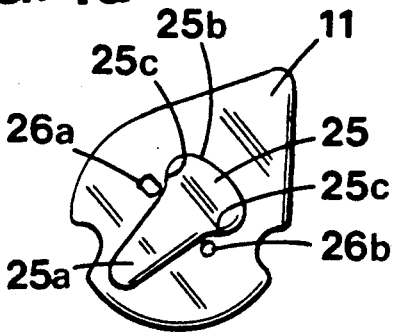
FIGS. 4*a* and 4*b* are plan views of two elements appearing in FIG. 3.
Figure 4B:
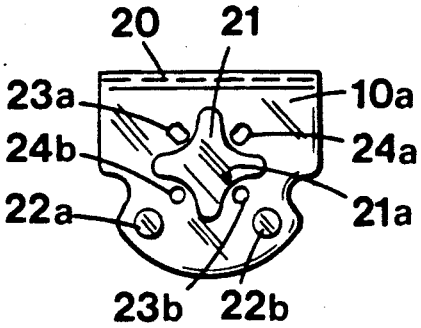

As will be seen from FIG. 4*b*, the plate 10*a* is presented in the form of a planar metal plate, incorporating a rectilinear fold 20 intended to define with the plate 11 a slot for the introduction of the thread, and whose surface presents three raised portions 21, 22*a* and 22*b*, obtained by stamping for example, and also passing through the surface of the plate, two pairs of apertures, namely a first pair of apertures 23*a* and 23*b* and a second pair of apertures 24*a* and 24*b*, respectively.

The raised portion 21 is flat and has the general form of a cross of which the edges of the arms include a connecting section 21*a* of rounded profile, of identical radius of curvature for each pair of arms, each section forming an indentation which opens in immediate proximity to the apertures 23*b*, and 24*a* and 24*b* respectively.

It will be noted that the raised portion 21 has arms of equal length and that the said apertures are situated, two by two, on each side of the transverse axes of symmetry of the cross.

For each pair of openings, one pair 23*a* and 24*a* respectively have a slightly elongated form, the other pair 23*b* and 24*b* respectively, being of circular form. This difference in shape is chosen to allow a certain amount of play, which should allow easy passage of the rods 12*a* and 12*b* even if their spacing is not rigorously constant.

The raised portions 22*a* and 22*b*, of circular shape, are disposed in such a way that their respective centre is situated on the transverse axis of symmetry of the raised portion 21 which passes through the apertures 24*a* and 24*b* for the portion 22*a*, and through the apertures 23*a* and 23*b* for the portion 22*b*.

The structure of the plate 10*b* is exactly the same as that described above in relation to the plate 10*a*, and the above description may be referred to for information as to the details of the plate 10*b*.

As will be seen in the drawing (FIG. 2), the plate 11 is mounted between the plates 10*a* and 10*b*.

The plate 11 includes, on each of its faces, a raised planar portion 25 which is obtained by stamping of the plate, in the case of the raised portion appearing on one side of the plate. The raised portion on the reverse face of the plate 11 may be formed by joining on, for example by brazing, to the depressed surface of the plate formed by the stamping operation, a smaller plate, not shown, of a shape corresponding to that of the portion 25, this brazed plate forming a projection on the surface of the plate as is the case for the raised portion 25 appearing on the other face of the plate 11.

The raised portion 25 is provided with an elongated part 25*a*, of a generally triangular shape, with a rounded apex the curvature of which approximately corresponds to that of the raised portions 22*a* and 22*b* of the plates 10*a* and 10*b*. The portion 25 has a wider part 25*b*, the edge of which is joined to the edge of the part 25*a* by two curved sections 25*c* forming corresponding opposed indentations. The radius of curvature of the sections 25*c* approximately corresponds to that of each of the identations 21*a* included between each pair of arms of the protruding cruciform portion 21 of the plates and 10*a* and 10*b*. On either side of the raised portion 25, the plate 11 is provided with apertures 26*a*, 26*b* respectively the shape and spacing of which correspond to those of the pairs of apertures 23*a*, 23*b*, respectively or 24*a*, 24*b*, 24*b*, respectively of the plates 10*a* and 10*b*. The centres of the apertures 26*a* and 26*b* are situated on a common axis which is perpendicular to the longitudinal axis of the raised portion 25, and the centres are equidistant from, and on either side of, said longitudinal axis.

It will be noted again that the general dimensions of the raised portion 25, the profile of its edges and its position with respect to the apertures 26*a* and 26*b* are chosen such that, in the assembled position of the plates 10*a*, 11 and 10*b*, the rounded parts 25*c* of the raised portion 25 of the plate 11, and of its opposed raised portion which protrudes from the reverse face of the plate 11 are located to the right of a part of the lengths of the indentations facing onto the apertures 24*a* and 24*b* of the plate 10*a*, and onto the apertures 23*a* and 23*b* of the plate 10*b*, respectively.

Furthermore, the raised portion 25 rests, by its extremity 25*a*, on the raised portion 22*a* of the plate 10*a*. In the same way the raised portion 22*b* of the plate 10*b* forms a support for the opposed extremity 25*a*, belonging to the corresponding raised portion, on the reverse face of the plate to the portion 25.

Figure 3:
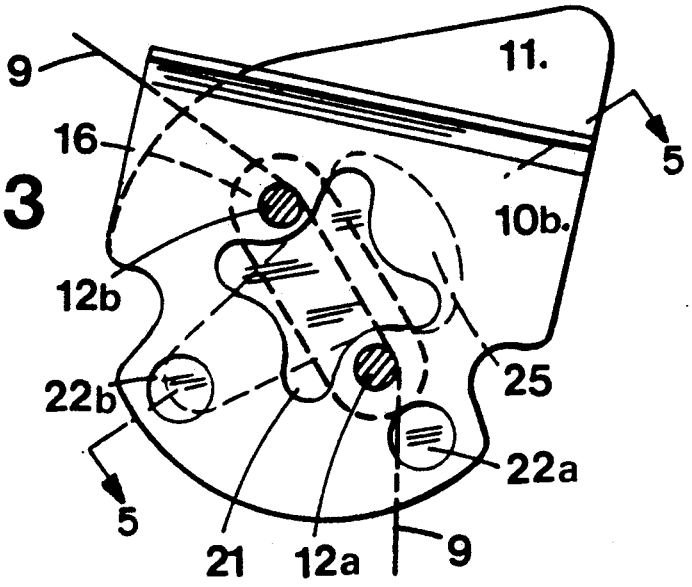
FIG. 3 is a view of a detail of FIG. 1 on a larger scale.

As will be seen in FIGS. 1 and 3, in the operating mode of the sewing machine, the thread 9 passes between the plates 10*a* and 11, and is taut between the rods 12*a* and 12*b* and is in contact with the raised portions 21 and 25 of the plates. The thread is gripped between the plates under the action of the rod 14 (FIG. 2) depending upon the pressure exerted on this by the lever 17.

The edge of the indentations appearing on one face and also on the other face of plate 11, and that of the indentations of plates 10*a* and 10*b* overlapping the first edge above mentioned define two pairs of lips between which the thread passes upon entering as well as on leaving from, between the pair of plates.

As has been indicated in U.S. Pat. 4,123,984, the provision of two diametrically opposed indentations of rounded profile which intersect the thread bearing surfaces of the plates of the device which is described therein, and of requiring the thread to enter between these surfaces across the lips so defined, at one extremity of the plates, manifests itself on the portion of thread entering each instant between these lips, by the appearance of a thrust arising from the resolution into two vectors of the force of axial pull exercised on the thread this thrust being orientated tangentially to the profile of the indentations and in a centripetal direction, and so ought to prevent the thread from leaving the device.

According to the above patent it was intentionally chosen to arrange for the thread to enter between the plates at the extremity of the two lips which they define such that the above mentioned pull would be of a maximum value and thus that the maintaining of the thread between the plates would be guaranteed even in extreme operating conditions of the machine.

As is seen in the drawing, and as follows from the description, the device according to the invention does not fulfill this last condition as the thread enters between the first pair of lips of each pair of plates 10*a* and 11, 11 and 10*b*, respectively, and leaves by the second, across a central portion of each pair of lips and not at the extremities of these. It follows that the thread is also evidently subjected to the action of a centripetal pull of the same kind and for the same reasons as those cited above as it would have been if the thread, as in the above patent, had passed between the lips at a point much more distant to their central portion.

Despite this, experience has shown that the device herein described was particularly effective because, even in the extreme operating conditions mentioned previously, the section of thread crossing at each instant the space included between the gripping surfaces of the plates is never removed by more than several tenths of a millimetre from the ideal trajectory, which is that in which the thread occupys a taut position between the bars 12*a* and 12*b*.

This unexpected result is due first of all to the fact that, contrary to that which is advocated by U.S. Pat. No. 4,123,984, the thread enters and leaves the gripping zone of the device across two pairs of lips on contact with which it is subjected to the action of a centripetal pull tending to prevent it leaving this space: the portion of thread crossing the said space is thus practically held at its two extremities.

Also, taking account of the shape given to the gripping surfaces with which the plates 11, 10*a* and 10*b* are provided, and of their position with respect to the trajectory taken by the thread, both upstream and downstream of the device, it is seen that if, by hypothesis, the portion of thread crossing the gripping space of each pair of plates tended to be pushed in a centrifugal direction, this portion would tend to be displaced onto a part of the gripping surface of greater length, and thus would be subjected to a greater frictional force creating an obstacle naturally limiting the possibilities of "migration" of the thread in a centripetal direction. The thread, on the contrary, tends to displace itself of its own accord onto a portion of the gripping surface offering the least resistance to its passage; in the circumstances the ideal position ought theoretically to coincide with the transverse axis of symmetry of the raised cruicform portion 21 (FIG. 3).

Figure 5A:
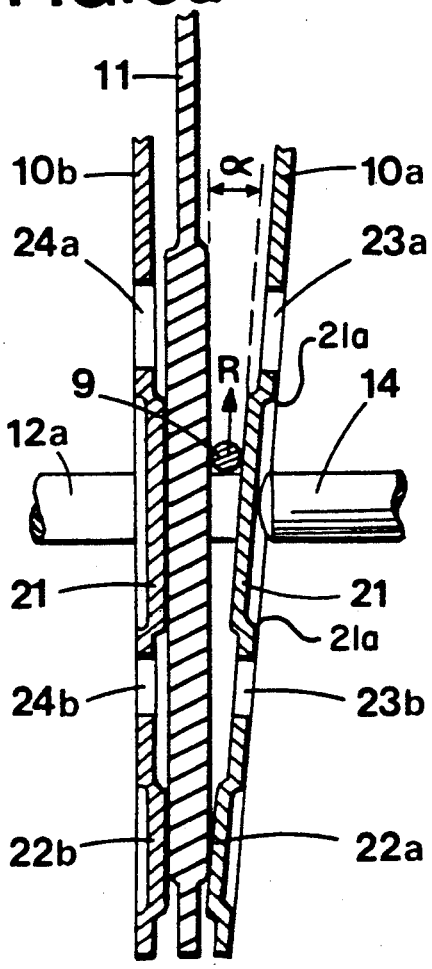
FIGS. 5*a* and 5*b* illustrate, comparatively, a detail of the working of the device in accordance with the invention, and of a conventional device.
Figure 5B:
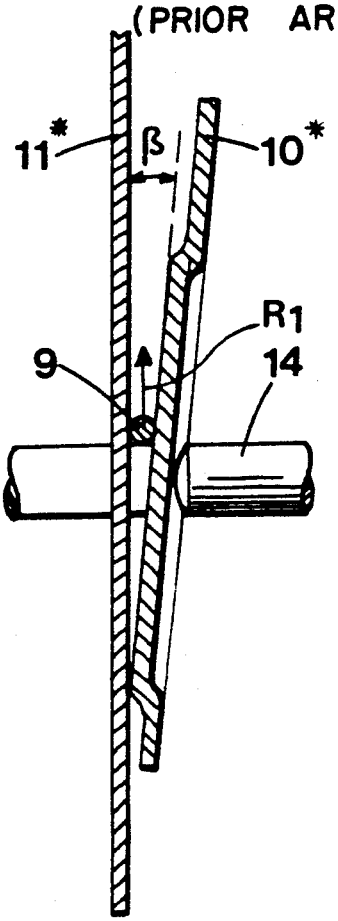
FIG.5b (PRIOR ART)

To these two technical measures allowing the attaining of the good result cited, it is convenient to mention that of the mutual putting into operation of the raised portions 22*a* and 22*b* of the plates 10*a* and 10*b* and of the extremity 25*a* of the portion 25 of the plate 11. For this we refer to the FIGS. 5*a* and 5*b* of the drawings. The first of these shows, in longitudinal section along the line V—V of FIG. 3, the position occupied by the various plates of the device according to the invention, when a thread 9 is engaged between the plates 10*a* and 11. The second illustrates a similar situation in the case of a device of known structure, for example of U.S. Pat. No. 4,123,984.

It is seen, in the first case (FIG. 5*a*), that by the presence of the thread 9 between the plates, the plate 10*a* occupies a slightly tilted position with respect to the plate 11. For a thread having a diameter of 0.4 mm, the angle of tilt is of the order of 2°.

In the second case (FIG. 5*b*), the angle of the plate 10 with respect to the plate 11 is much greater as it is of the order of 2° 48'. This signifies that, in this case, the thread 9 will have much greater ease in escaping from the space included between the plates, implying, by this fact, the obtaining of a sewing of bad quality due to the irregularities in tension to which the thread is subject.

This difference in behaviour of the two gripping devices described is due to the fact that, in the device according to the invention, the possible tilt of the external plates, 10*a* or 10*b*, of the device is limited by the mutual support of the raised portion 22*a* or 22*b* and by the part 25*a* of the raised portion 25 of the plate 11 or by their corresponding parts on the reverse face of the plate 11. As a consequence the force R acting on the thread as a result of the "wedge" effect to which it is submitted is inferior to the corresponding force $R_1$ existing in the case of the device of FIG. 5*b*.

It goes without saying that the device of the invention could be limited to a single pair of plates (10*a* 10*b*) notably in the case of a machine having only the possibility of sewing with a single thread and not with two. Moreover, even in this case the angle, to which reference has been made in the description of FIG. 5*a*, will be of similar value to that cited previously. In effect this result remains valid, seeing that, in the manner which has been described, the plates will thus be in mutual contact by their respective raised portions, 22*a* and 22*b*, and 22*b* and 22*a*, respectively.

As a modification, and under the same conditions above mentioned, it would equally be possible to make use of but one pair of plates of a structure corresponding to that of plate 11 described above, and on which the elevated part would be bent in such a manner as to obtain a groove of V form at the top of the assembly of the plates, which would facilitate the introduction of a thread between the plates.

I claim:

1. A device for controlling the tension of a longitudinally moving thread, comprising at least first and second adjacent plates, applied one against the other wherein the thread passes therebetween, means for applying pressure to said plates, and thus to tension the thread to a desired tension, said plates having opposed surfaces wherein each plate incorporates at least one gripping surface for gripping the thread cooperating with at least one gripping surface of the other plate, a periphery essentially about the gripping surfaces of the plates being formed with at least two indentations arranged in such a way that each indentation of the gripping surface of the first plate coincides with at least a portion of a corresponding indentation on the gripping surface of the second plate, at least in one relative angular position of the plates, the pairs of indentations so superimposed defining, on the periphery of the gripping surfaces of the plates, two distinct and concave lips, means for maintaining the plates in said angular position, means for projecting on that portion of thread crossing the device at any instant, a trajectory such that the thread enters between the gripping surfaces of the plates by one of said lips and leaves by the other lip.

2. A device as claimed in claim 1, wherein said means for projecting comprises at least two support members for the thread, one of the support members facing onto one of said lips and the other support member onto the other lip.

3. A device as claimed in claim 2, wherein said support members are arranged in said indentation.

4. A device as claimed in claim 3 wherein that the said support members are constituted by the portion of the said rods included between the plates.

5. A device as claimed in claim 4, wherein, on the face including the gripping surface, the first of said adjacent two plates presents at least one support surface located in a position remote from said gripping surface, and substantially equi-distant with respect to said apertures, the gripping surface of the second of said adjacent two plates extended such that said gripping surface rests, at least in part, on said support surface in a gripping position of said plates.

6. A device as claimed in claim 4, wherein the gripping surface of the first plate is in the general form of a cross comprising arms, wherein edges of each arm include a section of rounded profile, each rounded profile having a same radius of curvature as the other sections of rounded profile, extending in proximity to an intersection of each said arms, said second plate gripping surface and said edges of each pair of arms forming said indentation, wherein said first plate is provided with two pairs of apertures, each formed in a portion of the plate situated between two adjacent arms of the gripping surface in immediate proximity to a connecting section of edges of said two adjacent arms, said first plate including two support surfaces, one being traversed by a geometric axis passing simultaneously through the first pair of apertures formed between opposing pairs of arms of the cruciform profile of the gripping surface, and the other support surface being located in a position symmetrical to the first support surface and being situated on the axis passing through the second of said pair of openings.

7. A device as claimed in claim 6, wherein the gripping surface of the second plate extends longitudinally and symmetrically between the apertures, along to a geometric axis equidistant from the apertures, at least one portion of the edge of this surface forming two indentations, each opening adjacent to one of the said apertures, and in the direction of these.

8. A device as claimed in claim 1 wherein each plate has a raised central portion forming the gripping surface of the plate.

9. Device as claimed in claim 1, wherein each plate is provided with at least two apertures, the dimensions and spacing of said apertures are identical from plate to plate, and each plate is slidably mounted on two rods, each passing through a predetermined aperture, the relative position of the apertures of each plate and of the indentations of the respective gripping surface of each plate being selected in such a way as to obtain said superimposition of the corresponding indentations of the gripping surfaces of the plates, the rods and apertures comprising said means of angular positioning of the plates.

* * * * *